United States Patent [19]

Deters

[11] Patent Number: 4,460,620

[45] Date of Patent: Jul. 17, 1984

[54] INSULATED ELECTRICAL CONNECTOR AND METHOD OF MAKING SAME

[75] Inventor: Paul M. Deters, Manhattan Beach, Calif.

[73] Assignee: Bussco Engineering, Inc., El Segundo, Calif.

[21] Appl. No.: 339,994

[22] Filed: Jan. 18, 1982

[51] Int. Cl.[3] ..... H01R 43/00

[52] U.S. Cl. ..... 427/58; 29/883; 29/885; 118/500; 118/504; 264/274; 264/275; 427/195; 427/282; 427/287; 427/318; 427/374.4

[58] Field of Search ..... 427/58, 195, 282, 287, 427/318, 374.4; 264/274, 275; 29/883, 885; 118/500, 504

[56] References Cited

U.S. PATENT DOCUMENTS

| | | | |
|---|---|---|---|
| 3,182,381 | 5/1965 | Johnston | 29/885 |
| 3,698,083 | 10/1972 | Schreck | 29/883 |
| 3,958,039 | 5/1976 | Yabuki | 427/195 |
| 4,114,976 | 9/1978 | Selvin | 264/274 |
| 4,124,729 | 11/1978 | Kubota | 427/58 |

*Primary Examiner*—John D. Smith
*Attorney, Agent, or Firm*—Jack C. Munro

[57] ABSTRACT

An electrical connector which is covered on its exterior surface with a non-adhering, non-electrically conductive material. The electrical contact surfaces of the electrical connector are free of the non-electrically conductive material. This electrical connector is manufactured by mounting the electrical connector on a mounting fixture wherein the electrical contact surfaces are in direct contact with the mounting fixture, heating the electrical connector to within a desired temperature range, then submerging the electrical connector in a quantity of powdered plastic which evenly coates the exterior surface of the electrical connector, removing the electrical connector from the powdered plastic, reheating of the electrical connector to cause fusing of the powdered plastic into an integral mass, cooling of the electrical connector and then removing such from the mounting fixture.

5 Claims, 11 Drawing Figures

INSULATED ELECTRICAL CONNECTOR AND METHOD OF MAKING SAME

BACKGROUND OF THE INVENTION

The field of this invention relates to an electrical connector for establishing an electrically conductive path between a first electrically conductive member and a second electrically conductive member.

The use of printed circuit boards for establishing a given electrical circuit is well known. In using printed circuit boards, it is normally mandatory that a certain number of electrical devics, such as capacitors, common grounds known as bus bars, resistors and inductors, be mounted directly on the circuit board and be electrically connected with the electrical circuit of the board. The mounting of these electrical devices on the printed circuit board is accomplished through electrically conducting members which extend from the circuit board. These electrically conductive members are generally what are referred to as male electrical conductors, which are normally in the form of a plurality of spaced-apart prongs.

An electrical connector is to be utilized to connect one prong to another prong to establish an electrically conductive path therebetween. In the past, such electrical conductors have taken numerous forms, such as for example, a bare wire being wrapped onto each pair of prongs and extending therebetween. Numerous types of clips and bus bars have also been employed. Because in recent years, printed circuit boards have become small in size, the electrical connectors to establish the electrically conductive paths have also become small in size. This small size has required to avoid electrical shorts, that these electrical connectors should be covered with a non-electrically conductive material.

Because these electrical connectors are of such a small size and in any given printed circuit board there may be a substantial number of such electrical connectors utilized, it is desirable that these electrical connectors be covered with the electrically insulative material in a manner to minimize cost of manufacture.

In any given piece of electrical equipment, there may be thousands of such electrical connectors utilized. It is important to discover a way to manufacture these electrical connectors in mass, which are covered with a non-electrically conductive material only on the exterior surface, but does not interfere with the electrical connection. This method of manufacture must minimize manufacture expense.

SUMMARY OF THE INVENTION

The electrical connector of this invention relates to an electrical clip which is designed to be placed upon a pair of electrically connective members, such as a pair of prongs which extend from an electrical apparatus as a printed circuit board. The electrical connector is formed of a metallic body which has a pair of openings with a prong to be located within each opening. The exterior surface of the surface of the electrical connector is covered with a non-adherent plastic coating. The method of making this electrical connector is by mounting each electrical connector on a mounting fixture. The mounting fixture is then to be located on a mounting station, such as on the circumference of a wheel. The wheel is to then be rotated to a first heating station which is to raise the temperature of the electrical connectors to between three hundred degrees Fahrenheit and three hundred and fifty degrees Fahrenheit. The electrical connectors are then caused to pass through a path which contains a quantity of finely powdered plastic composition. The powdered plastic is then attracted to the heated connector and adheres to the exterior surface of the connector. After removal from the path, the electrical connector is then reheated which causes the plastic to fuse forming a coating on the exterior surface of the connector. The temperature of the reheating should be at least three hundred and forty degrees Fahrenheit. The time for reheating should be three to five minutes. This coating completely covers the exterior surface, but is non-adherent to the electrical connector. The resulting coating is of a relatively soft plastic. The electrical connectors are then cooled and removed from the mounting fixture and then are ready for use. The mounting fixture completely covers the electrical contact surface of the electrical connectors so that the coating will not interfere with the electrical connections established by the electrical connector.

DETAILED DESCRIPTION OF THE SHOWN EMBODIMENT

Figure 1:
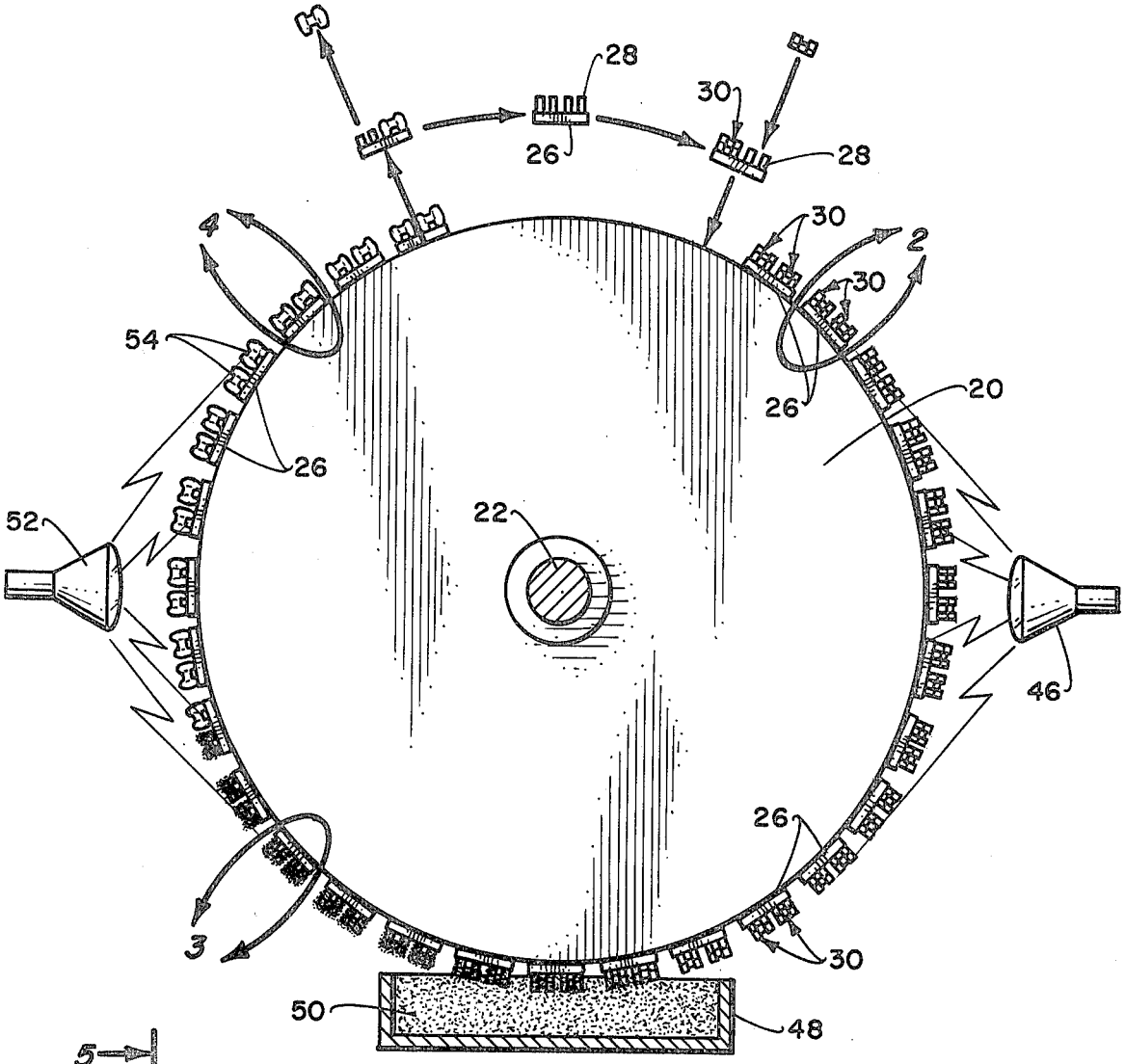
FIG. 1 is a diagramatic view showing the structure which could be utilized in the making of the insulated electrical connector of this invention.
Figure 2:
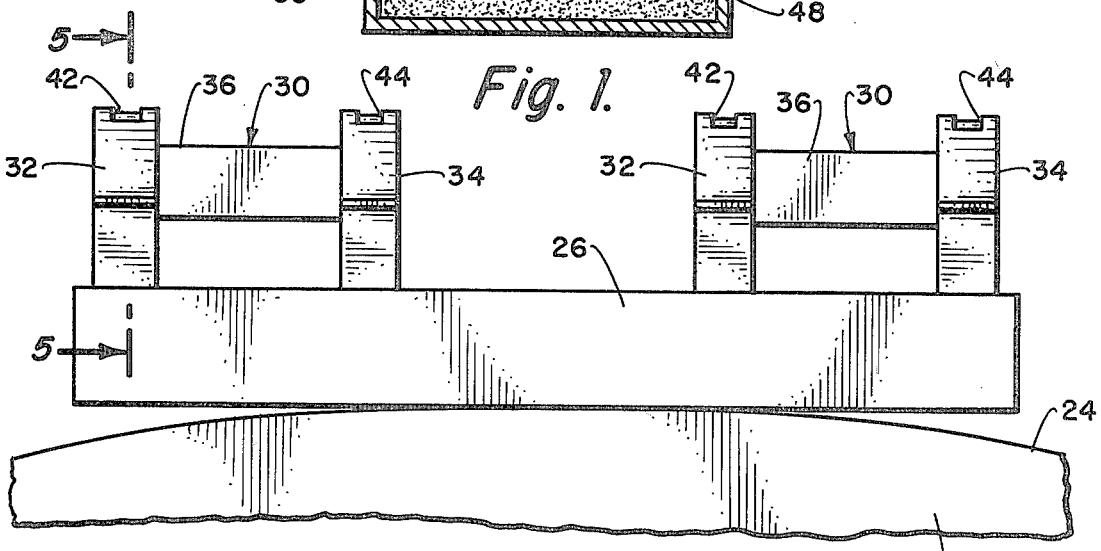
FIG. 2 is an enlarged view of a portion of the mounting fixture utilized in the manufacturing of the insulating electrical connectors of this invention taken along line 2—2 of FIG. 1.

Referring particularly to the drawings, there is diagramatically shown in FIG. 1 a wheel 20. The wheel 20 is rotated from a power source (not shown) by shaft 22. The wheel 20 has a circumferential periphery 24.

Mounted on the periphery are to be one or more rows of mounting fixtures 26. Each mounting fixture 26 is identical and includes a plurality of upstanding prongs 28. Each fixture 26 is to be connectably removable to the periphery 24 of the wheel 20. This connection can take any conventional form, such as a dove tail slot assembly, or the like. Also, a magnetizing type of attachment could be utilized. It is to be understood that this connection forms no specific part of this invention.

It is shown in the drawings that the mounting fixture 26 is to be temporarily secured to the periphery 24.

Prior to locating of each mounting fixture 26 onto the periphery 24, a metallic clip 30 is to be mounted on adjacent pairs of prongs 28. Each of the clips 30 include a pair of U-shaped members 32 and 34 which are connected together by a cross-member 36. The U-shaped member 32 includes an internal opening 38. A similar internal opening 40 is formed within the U-shaped member 34. Within the apex of the member 32 is formed a hole 42. A similar hole 44 is formed within the apex of the member 34.

One prong 28 is to be located within an internal opening 38 and an adjacent prong 28 is to be located within a internal opening 40. When the prongs 28 are located within the openings 38 and 40, the inner wall surfaces of the members 32 and 34 are in abutting contact with the exterior surface of the prong 28. It is to be noted that the prong 28 is designed so that it will be in abutting contact with the surface of the openings 38 and 40.

It is to be noted that each mounting fixture 26 is shown to support two in number of the clips (or the electrical connectors) 30. Actually the mounting fixture 26 could support a substantially greater number if such is desired. Once the desired number of clips 30 have been mounted on the mounting fixture 26, the mounting fixture 26 is then installed in location on the periphery 24.

As the wheel 20 rotates, the clips 30 are caused to be heated by the first heat source 46. The first heat source 46 is shown to take the form of a radiant heater, but any type of heating means could be utilized. It is only important that the clips 30 be heated to within the range of three hundred to three hundred and fifth degrees Fahrenheit.

Figure 3:
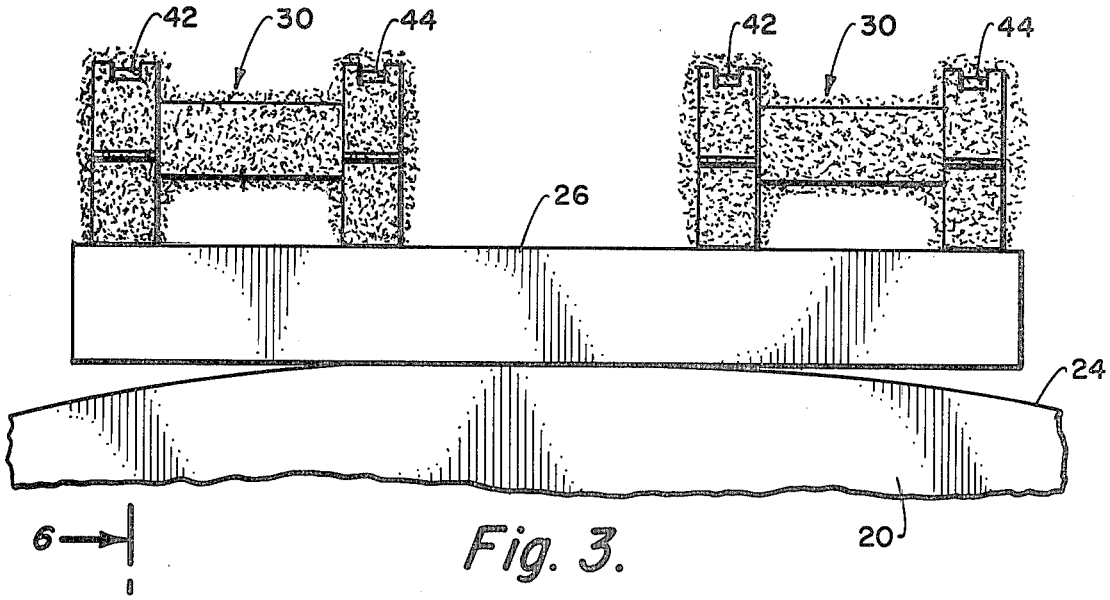
FIG. 3 is a view similar to FIG. 2 taken along line 3—3 of FIG. 1 showing the electrical connectors being coating with the powdered plastic.
Figure 4:
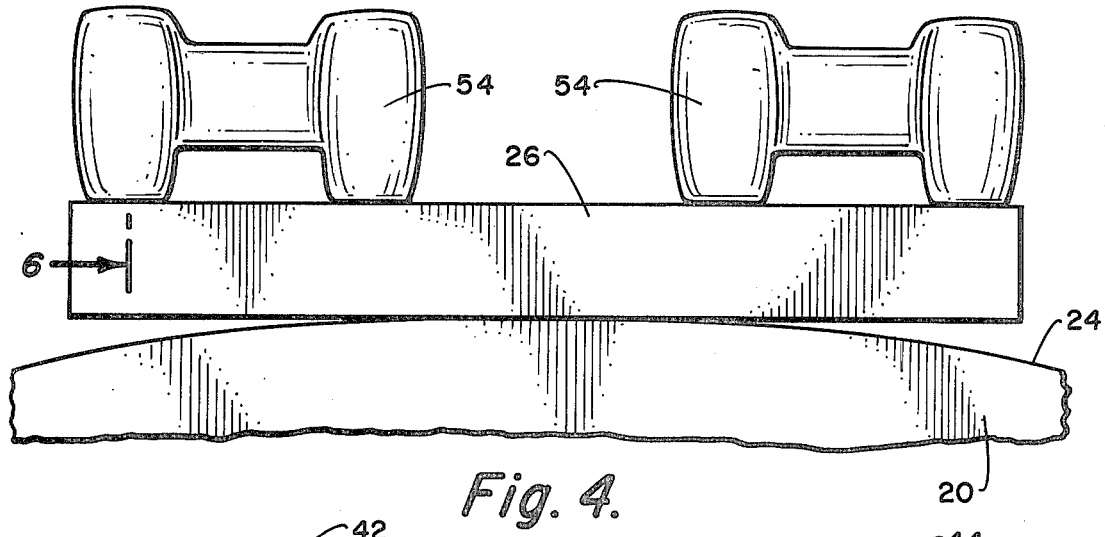
FIG. 4 is a view similar to FIG. 3 but taken along line 4—4 of FIG. 1 showing the electrical connectors being completely coated with the now fused plastic material.
Figure 8:
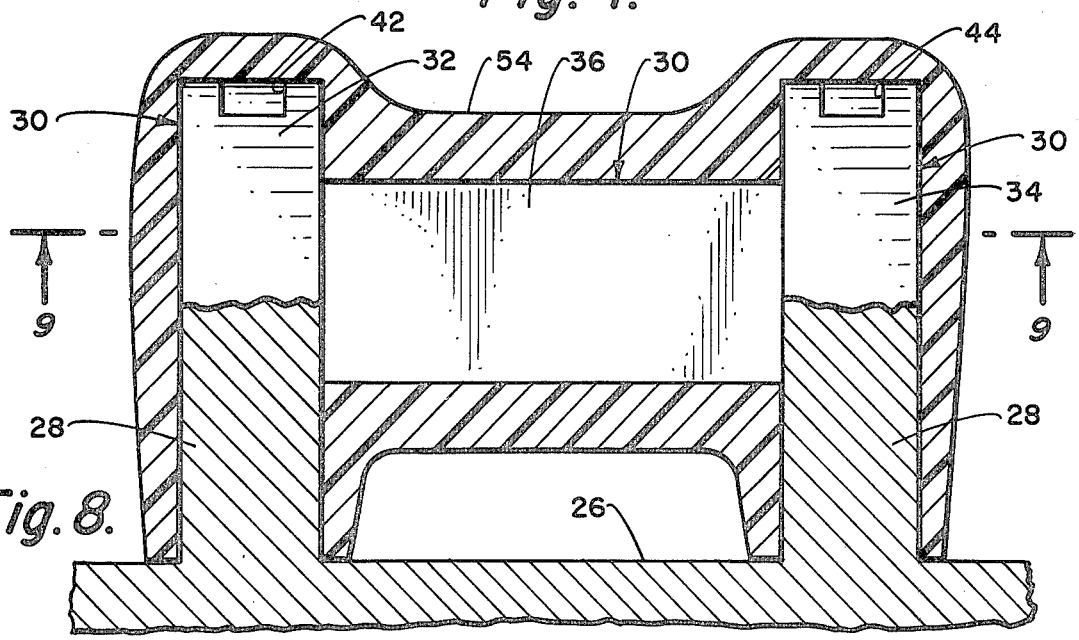
FIG. 8 is a cross-sectional view taken along line 8—8 of FIG. 6.
Figure 5:
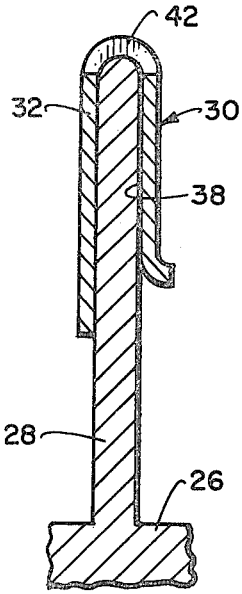
FIG. 5 is a cross-sectional view taken along line 5—5 of FIG. 2.
Figure 6:
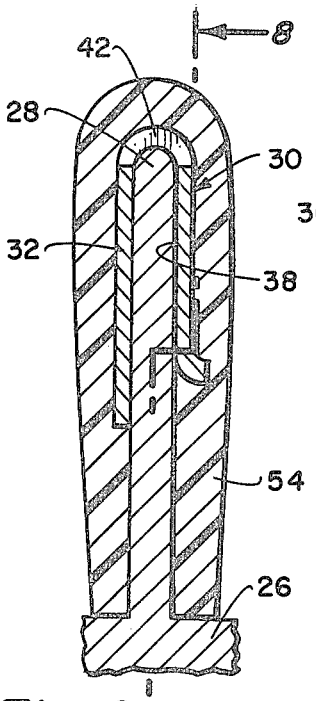
FIG. 6 is a cross-sectional view taken along line 6—6 of FIG. 4.
Figure 7:
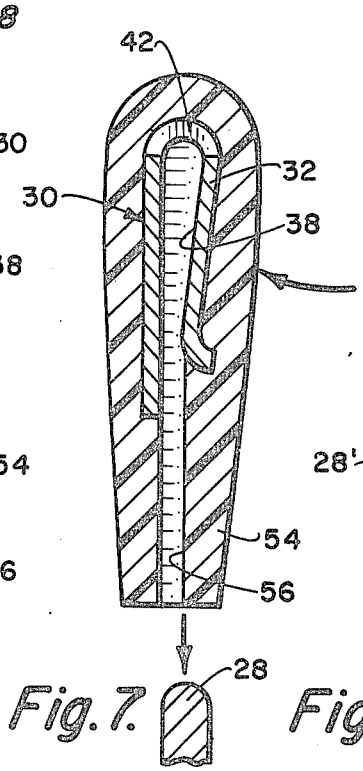
FIG. 7 is a view similar to FIG. 6, but showing the electrical connector having been removed from the mounting fixture.

The now heated clips 30 are to be revolved by the wheel 20 to come into contact with bath 48. Within the bath 48 is located a quantity of powdered plastic 50. The powdered plastic 50 will evenly adhere to the heated surface of the clips 30, as is clearly shown in FIG. 3. Further revolving of the wheel 20 removes the clips from the bath 48. The clips 30 are then heated by a second heat source 52, which is similar to the heat source 46. The heating temperature of the second heat source 52 should be around three hundred and forty to three hundred and fifty degrees Fahrenheit. The heat source 52 functions to liquify the powdered plastic which is clinging to each clip 30. The powdered plastic on each clip 30 then fuses and solidifies forming a flexible, soft plastic coating 54. The necessary time required to form the coating 54 is approximately three to five minutes.

Further revolving of the wheel 20 results in cooling of each of the clips 30 which then permits each of the now completely coated clips 30 to be removed from the prongs 28 and are now ready to be used. During use of the clips 30, there is an opening 56 formed within the coating 54 which connects with the internal opening 38. A similar such opening is provided within the coating 54 to connect with the internal opening 40. This facilitates insertion of the clip 30 onto its appropriate male electrical connector (not shown). Also, the coated clip 30 can be utilized in a reverse manner wherein the male electrical connector can be caused to penetrate the portion of the coating 54 adjacent the apex of each of the U-shaped members 32 and 34. This male electrical connector (not shown) will then be inserted through the appropriate holes 42 and 44 to engage with the electrical contact surfaces within the internal openings 38 and 40.

The wheel 20 may be vibrated so that each of the clips 30, as it is being conducted through the quantity of powdered plastic 50, is caused to evenly coat the exterior surface of each of the clips 30.

Within the quantity of powdered plastic 50, there may be passed a gas. The function of the gas is to levitate the powder. The function of the preheating of the clip 30 is so that the powdered plastic 50 will melt on contact with the clip 34 forming the coating.

The composition for the powdered plastic 50 is to consist of a resins, pigments, heat and light stabilizers, plasticizers and reinforcing fillers. There are known to be two methods for combining these constituents to form a homogeneous or balanced composition. These two methods are what are referred to as "melt mixing" and "dry blending".

Melt mixing is achieved by intensive milling of all ingredients, in a molten state at elevated temperaures, to develop maximum dispersion. After cooling and solidification, the composition is ground to the proper partical size. This process insures that the powder will be completely uniform in composition from particle to particle and batch to batch.

In dry blending, the constitutents are brought together in a dry state. Dispersion is accomplished by high shear mixing at elevated temperatures, but without melting the powdered base resin. Ingredient dispersion by this method is not as complete as melt mixing. However, there are numerous applications where this dry blending is satisfactory.

Some of the base resins used in the composition are vinyl, epoxy, polyester, nylon, and urethane.

Figure 10:
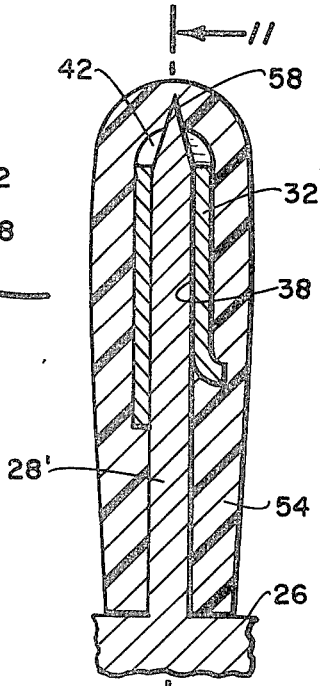
FIG. 10 is a view similar to FIG. 6, but of a modified form of mounting fixture.
Figure 9:
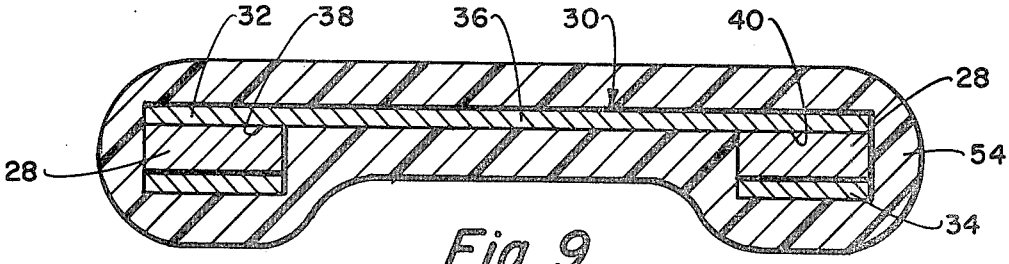
FIG. 9 is a cross-sectional view taken along line 9—9 of FIG. 8.
Figure 11:
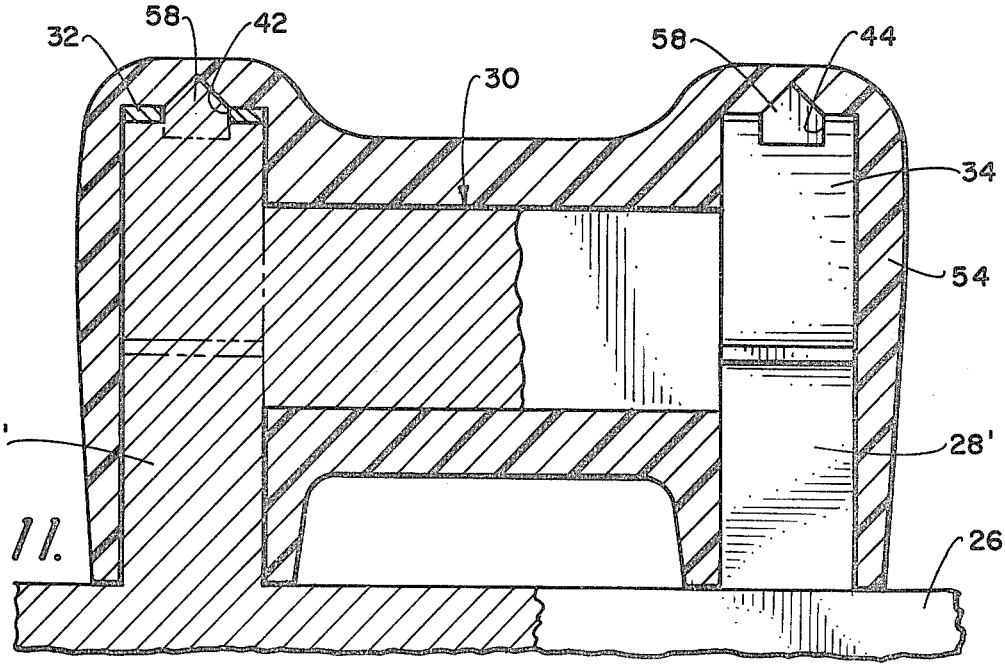
FIG. 11 is a cross-sectional view taken along line 11—11 of FIG. 10.

Referring particularly to FIGS. 10 and 11, there is shown a modification wherein each of the prongs 28' have a pointed outer end 58. The function of the outer end 58 is to partially penetrate the apex section of the coating 54 by extending through the holes 42 and 44. The use of the pointed prong 58 is to also keep the coating 54 from even slightly entering within the openings 42 and 44. It is desirable that the electrical contact surfaces of the internal openings 38 and 40 remain free of the coating 54 so as to not interfere with the electrical connection of the clip 30.

What is claimed is:

1. The method of making an insulated electrical connector comprising:

utilizing a plurality of fixtures wherein each fixture includes a prong assembly;

plugging a said electrical connector onto a said prong assembly wherein the electrical contacting surfaces are placed in direct contact with and are covered by said prong assembly thereby preventing coating of said electrical contacing surfaces;

locating a plurality of said electrical connectors on each said fixture;

attaching each said fixture onto the peripheral surface of a rotatable wheel forming a circumferential row of said fixtures about said wheel;

rotating the wheel which progressively moves said electrical connectors to be heated by a first heat source;

further rotation of said wheel causes submerging of said electrical connectors in a quantity of powdered plastic which then evenly adheres forming a coating on the exterior surface of the heated electrical connectors;

continued rotation of said wheel causes removing of the now coated electrical connectors from the powdered plastic;

continued rotation of said wheel causing heating by a second heat source of the coated electrical connector to a sufficient temperature and for a sufficient length of time to cause fusing of the powdered plastic into an integral mass;

continued rotation of said wheel causes cooling of the now coated electrical connector; and removing the fixtures from said wheel and then separating the electrical connectors from the fixtures.

2. The method as defined in claim 1 wherein the desired temperature range within the first heating step is between three hundred degrees Fahrenheit and three hundred and fifty degrees Fahrenheit.

3. The method as defined in claim 2 wherein the sufficient temperature within the second heating step is at least three hundred and forty degrees Fahrenheit.

4. The method as defined in claim 3 wherein the sufficient length of time within the second heating step is approximately three to five minutes.

5. The method as defined in claim 4 wherein both the heating steps are accomplished by radiation.

* * * * *